US006749520B1

(12) United States Patent
Neskudla et al.

(10) Patent No.: US 6,749,520 B1
(45) Date of Patent: Jun. 15, 2004

(54) DEVICE FOR PRACTICING GOLF

(75) Inventors: Rudolph John Neskudla, 8 Landon Way, Mount Claremont (AU), WA 6010; Timothy John Walmsley, Perth (AU); Carmelo Giovanni Micalizzi, Perth (AU)

(73) Assignee: Rudolph John Neskudla, Mount Claremont (AU)

( * ) Notice: Subject to any disclaimer, the term of this patent is extended or adjusted under 35 U.S.C. 154(b) by 0 days.

(21) Appl. No.: 09/743,147

(22) PCT Filed: Jul. 8, 1999

(86) PCT No.: PCT/AU99/00553

§ 371 (c)(1),
(2), (4) Date: Jan. 5, 2001

(87) PCT Pub. No.: WO00/02629

PCT Pub. Date: Jan. 20, 2000

(30) Foreign Application Priority Data

Jul. 8, 1998 (AU) ..... PP4563

(51) Int. Cl.[7] ..... A63B 69/36
(52) U.S. Cl. ..... 473/197; 473/432; 273/400
(58) Field of Search ..... 273/395, 396, 273/398, 399, 400, 401, 402; 473/197, 454, 455, 456, 476, 478, 150, 172, 195

(56) References Cited

U.S. PATENT DOCUMENTS

| | | | | | |
|---|---|---|---|---|---|
| 1,788,803 | A | * | 1/1931 | MacGeorge | 473/157 |
| 2,043,273 | A | * | 6/1936 | Watson | 473/190 |
| 2,123,195 | A | * | 7/1938 | Middleton | 221/258 |
| 3,895,809 | A | | 7/1975 | Shockley | |
| 4,556,219 | A | * | 12/1985 | Tillery | 473/197 |
| 4,815,736 | A | * | 3/1989 | Wright | 135/124 |
| 4,858,922 | A | * | 8/1989 | Santavaci | 473/192 |
| 5,018,731 | A | | 5/1991 | Doyle | |
| 5,088,740 | A | * | 2/1992 | Peterson | 135/127 |
| 5,244,213 | A | | 9/1993 | Armell | |
| 5,269,527 | A | * | 12/1993 | Noval | 473/197 |
| 5,433,433 | A | | 7/1995 | Armell | |
| 5,467,990 | A | * | 11/1995 | Kitzhaber | 473/164 |
| 5,492,319 | A | * | 2/1996 | Lee | 473/166 |
| 5,823,885 | A | * | 10/1998 | Stempfer | 273/400 |
| 6,319,145 | B1 | * | 11/2001 | Coughlan | 273/407 |

FOREIGN PATENT DOCUMENTS

| | | |
|---|---|---|
| AU | 79403/91 | 1/1992 |
| GB | 2140311 A | 11/1984 |
| WO | WO 85/02549 | 6/1985 |

OTHER PUBLICATIONS

Copy of patent application Ser. No. 10/360,370, entitled "Golf Practice Device", filed Feb. 6, 2003.

* cited by examiner

*Primary Examiner*—Mark S. Graham
(74) *Attorney, Agent, or Firm*—Merchant & Gould P.C.

(57) ABSTRACT

A device for practising ball sports comprising an enclosure (3) defined by a membrane supported from a self-supporting structure (7), the structure (7) comprising a base (8) having a playing surface (19) and having a forward edge (2) and a support means (9, 10) spaced forwardly and upwardly of the base (8) and supported at least in part from the base (8), the structure (7) further comprising an upstanding frame (11) supported from the sides (12,13) of the base (8) and extending over the base (8), the enclosure (3) being supported from the structure (7) to define a space (6) having an open end (4) and a closed end (5), the space (6) being of a general conical configuration, the open end (4) being supported from the base (8) to maintain the open end (8) in an open condition adjacent the forward edge (2) and the closed end (5) being supported from the support means in spaced relation to the open end (4), wherein the lower portion of the enclosure (3) is inclined downwardly from the closed end (5) to the base (8) to enable a ball thereon to return to the playing surface (19).

19 Claims, 9 Drawing Sheets

DEVICE FOR PRACTICING GOLF

FIELD OF THE INVENTION

The present invention relates to a golf training device.

BACKGROUND ART

Practice nets and backstops have been used as practice or training apparatus for golfers who wish to practice striking a golf ball without the golf ball travelling considerable distances. However, these types of apparatus suffer from the disadvantage of not being portable such that the golfer can practise striking the ball at any desired location.

U.S. Pat. No. 4,063,739 discloses a golf warm up net whereby a portable structure consists of a pair of upright posts which are adapted to be inserted into a ground surface, a substantially U shaped support member which is adapted to support a net therebetween and is located on an upper portion of the pair of posts and a bottom sleeve which contains a plurality of weights which retains the net in a substantially upright position.

U.S. Pat. No. 4,913,439 discloses a golf practice net apparatus consisting of an elongate cross member having arm portions pivotable between a deployed position in which arm portions are aligned with one another and a storage position in which the arm portions are in adjacent, generally facing abutment with each other whereby a net is securable along both arm portions of the elongate cross member.

U.S. Pat. No. 4,723,780 discloses a golf practice device consisting of a single net enclosure wherein a U shaped canopy is pivotally attached to the upper ends of vertical support members and is held in position for use by brackets which are pivotally attached to the upper portions of the vertical support members and secured to the lower end of the canopy by a nut and bolt arrangement.

U.S. Pat. No. 5,569,094 discloses a self-erecting golf practice net, which is portable and stops the flight of a golf ball and returns the golf ball generally to a selected location and which is foldable for storage and transport. The practice net has a sloping base formed so as to return the golf ball to a selected location and is formed from elastic frame members arranged to provide an upright net and a retaining means for selectively retaining the net in a folded position and for allowing the net to spontaneously move into an erect position when the retaining means is not engaged.

U.S. Pat. No. 5,018,731 discloses a golf ball driving practice apparatus comprised of a rigid framework which supports a conical net into which a player practice drives golf balls off a tee.

The problem with the above devices except for U.S. Pat. No. 5,018,731 is that they cannot be used indoors since they all use a substantially erect net whereby stray shots from a golfer will not necessarily be intercepted by the net and accordingly the ball may cause damage within a confined area. Furthermore most of the above devices utilise a spike or post to be inserted into a ground surface so as to secure the net in use.

While the invention disclosed in U.S. Pat. No. 5,018,731 does contemplate indoor use, this use is limited to non-domestic locations due to the inherent size of the device. Further it does not contemplate the ball returning to the playing area so that a user can strike the same ball again without taking any other intermediate action The present invention has as one of its preferred objects to provide a device for practising ball sports which is portable and self-supporting and avoids at least some of the difficulties of the prior art referred to above.

DISCLOSURE OF THE INVENTION

Accordingly, the present invention resides in a device for practising ball sports comprising an enclosure defined by a membrane supported from a self-supporting structure, said structure comprising a base having a playing surface and having a forward edge and a support means spaced forwardly and upwardly of the base and supported at least in part from the base, said structure further comprising an upstanding frame supported from the sides of the base and extending over the base, said enclosure being supported from said structure to define a space having an open end and a closed end, said space being of a general conical configuration, said open end being supported from the base to maintain said open end in an open condition adjacent the forward edge and the closed end being supported from the support means in spaced relation to the open end, wherein the lower portion of the enclosure is inclined downwardly from the closed end to the base to enable a ball thereon to return to the playing surface.

According to a preferred feature of the invention, the playing surface provides a support surface from which a ball can be struck into the space through the open end.

According to a preferred feature of the invention, the enclosure extends to each side of the base to provide lateral panels to each side of the base rearwardly of the forward edge. According to one preferred embodiment, the open end of the enclosure is of a general arcuate configuration having the ends located at each side of the base rearwardly of the forward edge, said open end being inclined forwardly from the ends wherein the portion of the enclosure between the open end and the upstanding frame provides the lateral panels. According to a preferred feature of the embodiment, the open end is defined by a resiliently flexible elongate member received in the edge of the membrane and resiliently deformed to define the open end. According to a preferred feature of the embodiment, the elongate member is hollow and accommodates a filament which extends through the elongate member and which is adapted to be fixed at either end to the base. According to a further preferred feature of the embodiment, the open end of the enclosure is further defined by a portion which underlies the base and which extends between the sides thereof said portion comprising a flexible resilient second elongate member received in the edge of the membrane and fixed at its ends to the sides of the base and said second elongate member being resiliently bent to an arcuate configuration extending rearwardly away from the forward edge. According to one embodiment of the invention, the enclosure has the general shape of a cylinder wherein one end of the cylinder accommodates the first and second elongate elements and the other end is gathered to provide the closed end.

According to a further preferred feature of the invention the membrane is formed of netting.

According to a further preferred feature of the invention, the tension of the membrane defining the enclosure between the upstanding frame and the closed end is such as to allow for movement of the membrane transverse to the surface of the space to enable the membrane to absorb the impact forces of any ball impacting on the membrane.

According to a further preferred feature of the invention, the space between the upstanding frame and the closed end is trumpet shaped.

According to a further preferred feature of the invention, the base comprises a substantially rectangular or square frame which defines the forward edge and sides of the base and which provides a support surface which comprises a panel received by the frame.

According to one particular embodiment, the base comprises a substantially rectangular or square base frame defined by a plurality of elongate elements fixed at their ends by corner elements and said support means comprises a strut member mounted to each side of the base frame adjacent to forward edge and extending forwardly from the forward edge, said strut members converging to, be supported by a junction element, said junction element being supported by an upstanding frame element depending downwardly therefrom, said junction element providing support for the closed end.

According to a further preferred feature of the embodiment, the corner elements of the base located at each end of the forward edge receive and support strut members.

According to a further preferred feature of the embodiment, the corner elements of the base located at each end of the forward edge receive and support strut members.

The invention will now be more fully understood in light of the following description of one specific embodiment.

BRIEF DESCRIPTION OF THE DRAWINGS

The embodiment will now be described with reference to the accompanying drawings, in which.

BEST MODE(S) FOR CARRYING OUT THE INVENTION

Figure 1:
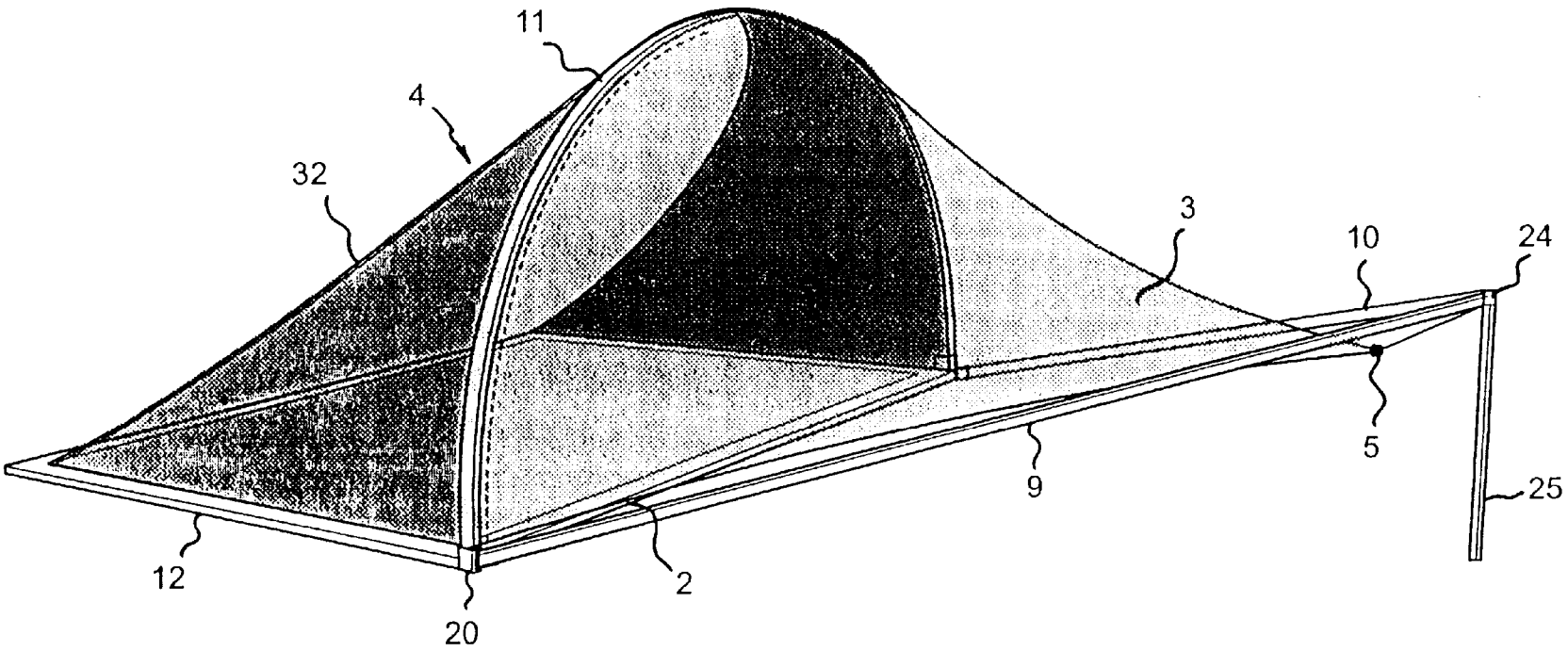
FIG. 1 is a front perspective view of a device for practising golf in accordance with the embodiment.
Figure 2:
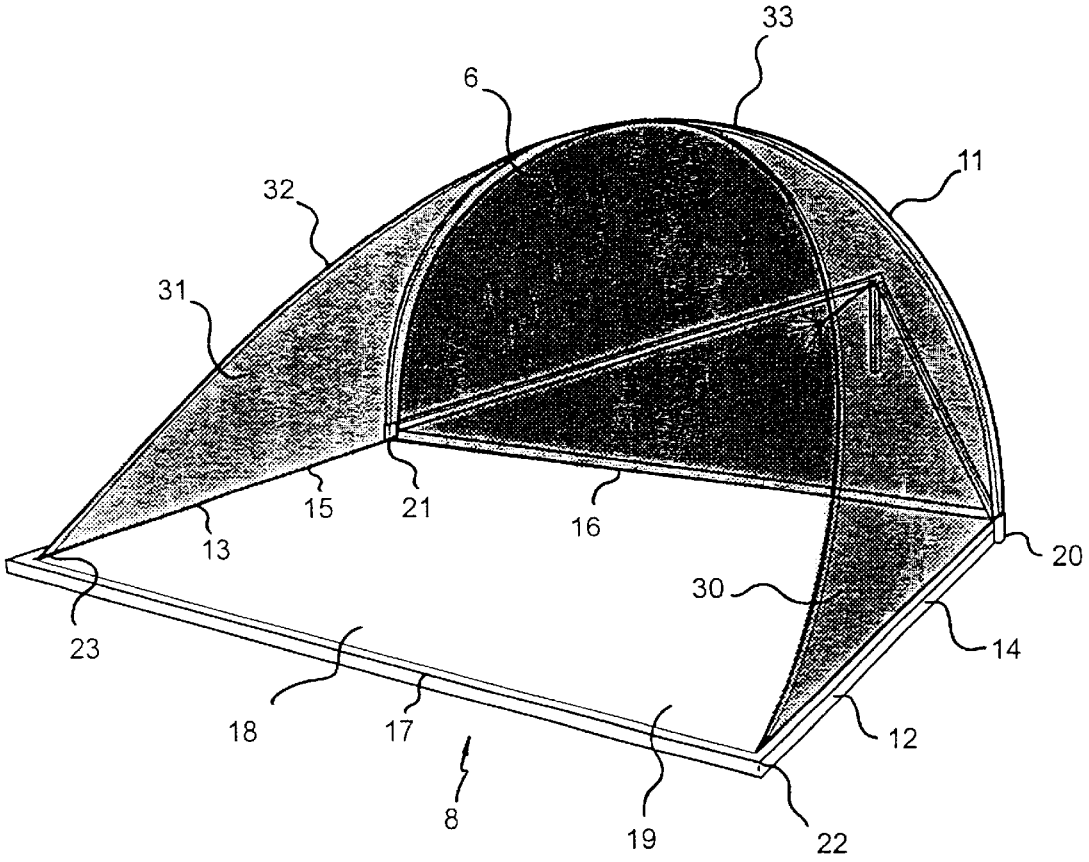
FIG. 2 is a rear perspective view of the device for practising golf as shown in FIG. 1.
Figure 3:
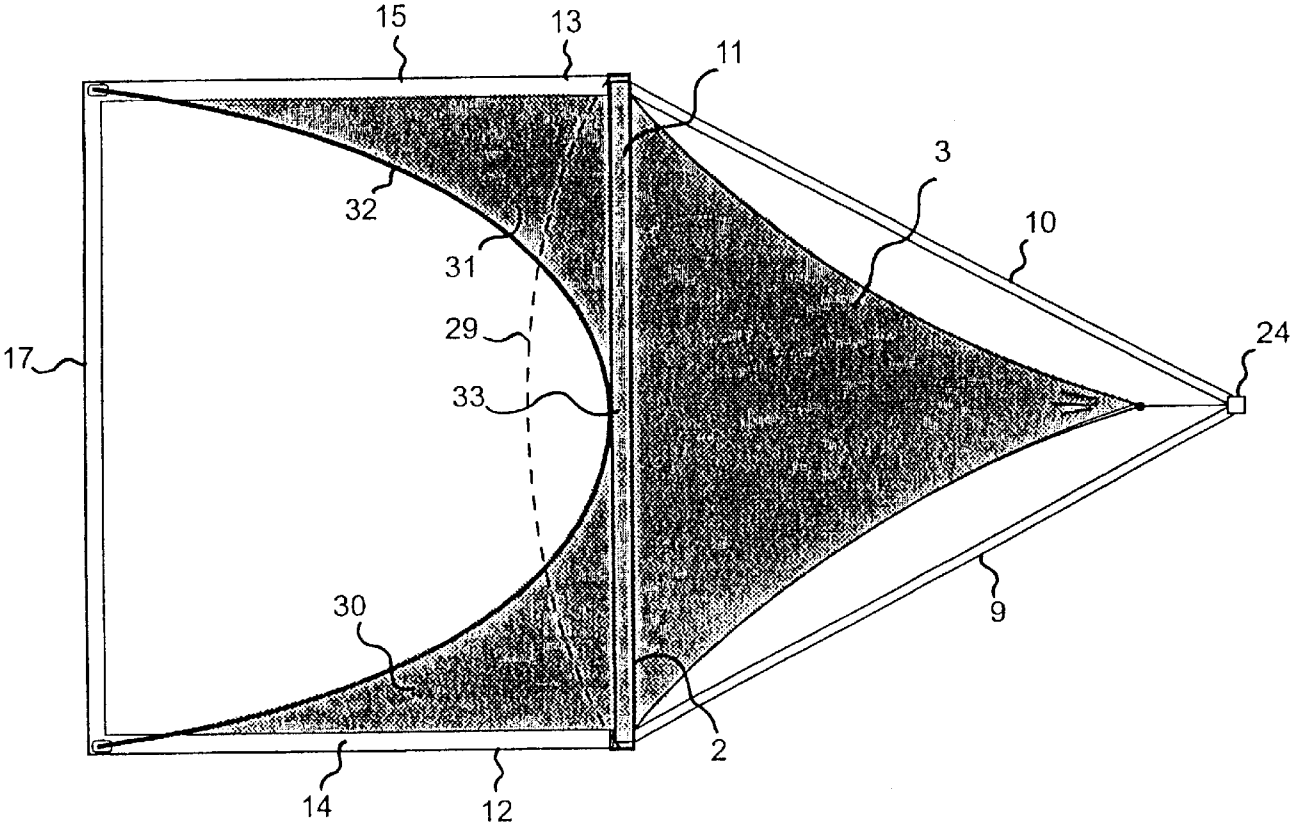
FIG. 3 is a plan view of the device for practising golf as shown in FIG. 1.
Figure 4:
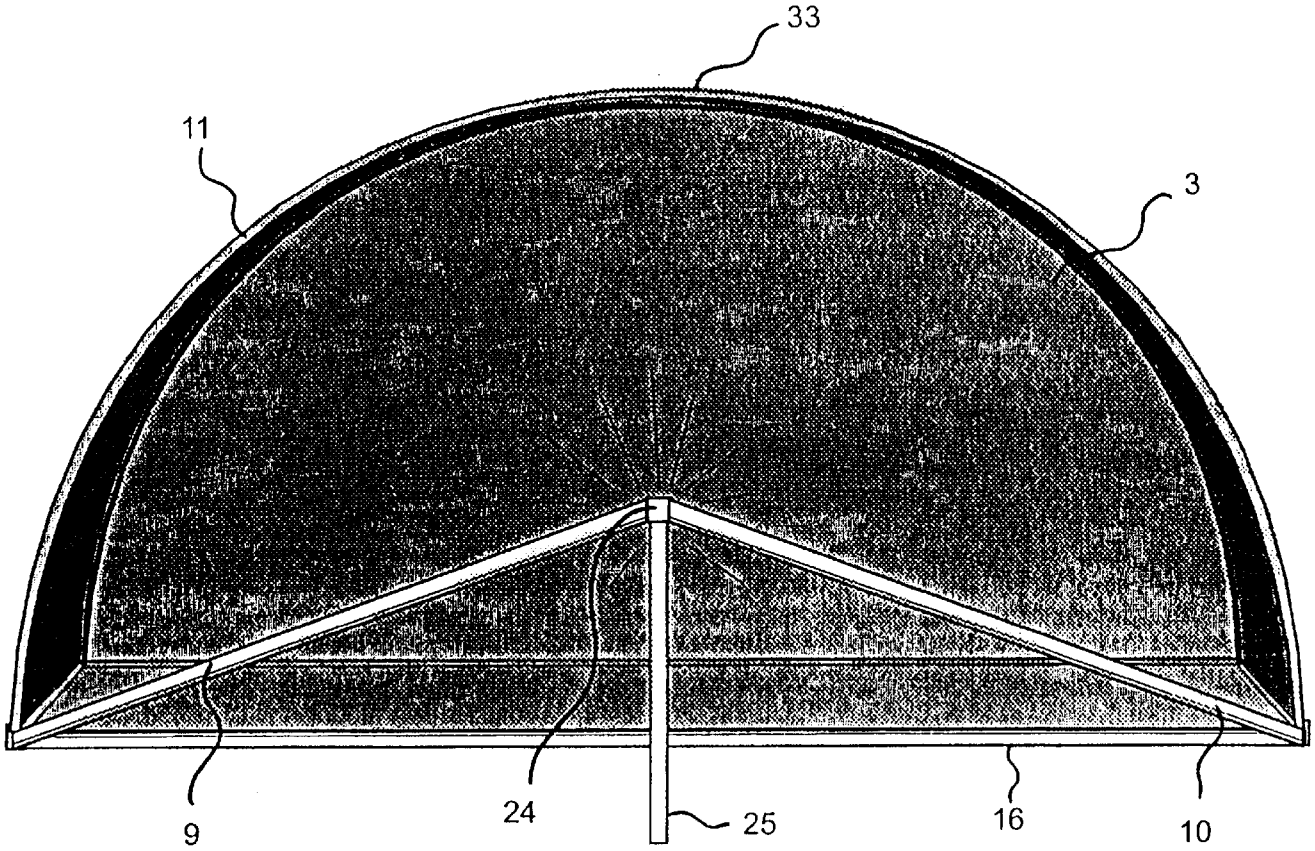
FIG. 4 is a front view of the device for practising golf as shown in FIG. 1.

According to a preferred embodiment of the invention, there is provided a device 1 for practising golf. However, it will be apparent to the skilled person that the device 1 may also be adapted for use for other ball sports including but not limited to soccer, rugby, Australian rules football and field hockey.

The embodiment will be described with reference to golf balls being struck by a golfer using the full range of clubs including metal woods, woods, other driver clubs including fairway woods, irons, etc. However, the invention should not be restricted in scope to this preferred embodiment and could easily be adapted for use for other ball games.

It is a feature of the embodiment that the device may be erected on any suitable support surface such as reasonably flat ground or on the floor of a room. It is a further feature of the embodiment that the device is freestanding and requires no other structural support such as being tied to pegs in the ground The device comprises an enclosure 3 for catching a ball (not shown) having a membrane in the form of a net having an open end 4 and a closed end 5 thereby defining a space 6 into which a ball may be projected The enclosure 3 is supported from a self-supporting structure 7 which comprises a base 8 with a front edge 2, a pair of support struts 9 and 10 extending forwardly of the base 8 and converging to be connected at their forwardmost ends by a junction element 24. The structure further comprises an upstanding frame 11 supported from the sides 12 and 13 of the base 8.

The base 8 of the structure 7 comprises a rectangular base frame defined by side members 14 and 15, a front member 16 defining the front edge 2 and a rear member 17. The members are fixed at their ends by two rear corner elements 22 and 23 and two front corner elements 20 and 21. The four members may be of any convenient material such as wood, plastics material or metal. To enhance portability, each member may be constructed from two or more sub-members joined together by joining elements (not shown). Thus when the structure is disassembled for transportation, the length of each sub-member will not exceed a length that may be conveniently carried in a car.

A panel 18 formed of a suitable resilient material such as rubber is received within the area enclosed by the base frame. The upper surface 19 of the panel defines the playing surface upon which a ball can be placed to be struck by the player into space 6. To enhance the feel and appearance of the playing surface, a covering such as artificial grass, outdoor or indoor carpet or matting is provided. The thickness of the panel and covering is substantially the same as the thickness of the base frame members to ensure that a ball does not encounter a bump or ridge when being struck or when returning to the user.

Figure 6:
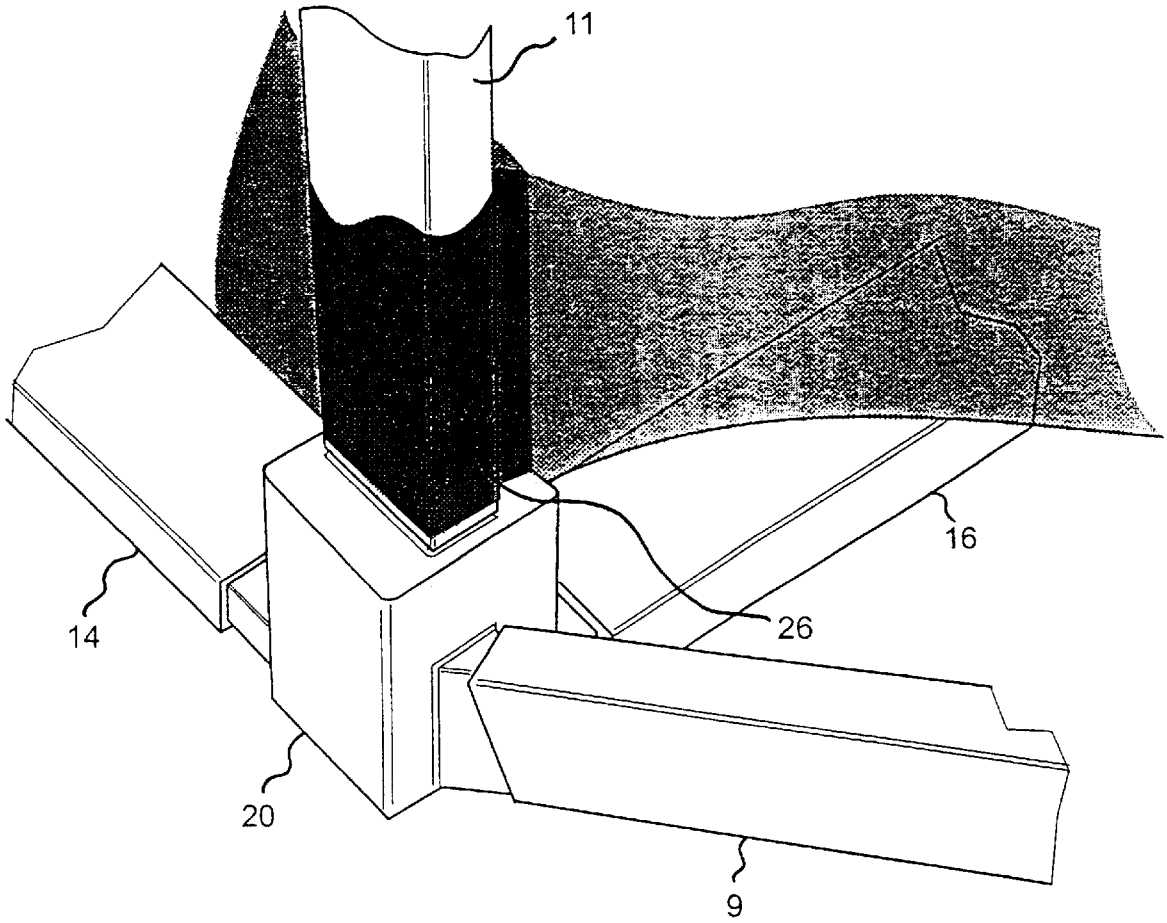
FIG. 6 is an expanded view of a front corner element of the base of the device for practising golf as shown in FIG. 1.

As shown in FIG. 6, the two front corner elements 20 and 21 at each end of the front member 16 are also adapted to disconnectably support the upstanding frame 11. The upstanding frame 11 is of rigid material such as wood, plastics material or metal and extends above the front base frame member. A substantially semi-circular shape is selected so as to conform to the shape of the netting. The frame can be constructed from two or more sub-members disconnectably joined together by joining elements, to provide a structure that is easily transportable and where all elements will fit within a car.

Also as shown on FIG. 6, the two front corner elements 20 and 21 at each end of the front member 16 are further adapted to engage the rear ends of the support struts 9 and 10 which extend forward of the base 8. The support struts 9 and 10 are rigid elements formed of convenient material such as wood, plastics material or metal. As stated, the forward ends of the support struts are connected by a junction element 24 to form an apex. The apex is supported above the surface upon which the structure is located by a rigid upstanding frame element 25. Again, each support strut can be constructed from two or more sub-members disconnectably joined together by joining elements, to provide a structure that is easily transportable and where all elements will fit within a car.

The membrane may be formed from any suitable material but netting of Rachell Knotless Knitted type has been found to be particularly suitable. Nylon is the preferred cord material for forming the netting. Other materials including polyester, polypropylene or polyethylene could also be used.

However, nylon is preferred to its superior strength which therefore provides the least weight per unit of area of netting material. It is also more pliable which enables the net to adopt the desired enclosure shape more readily and with lower tension applied. The netting mesh size is determined to be as large as practicable while still being capable of preventing the passage of the ball through the netting. The size selected will also depend upon the netting material chosen and its thickness. A net produced from nylon of 3 mm thickness with a mesh size of 16 mm×16 mm is considered optimum to stop a golf ball, although these parameters may be modified depending on the circumstances.

The enclosure 3 is manufactured in cylindrical form wherein a one end provides the open end and the other end provides the closed end. The enclosure 3 is supported at the open end 4 by the upstanding frame 11. The open end 4 also extends beyond the upstanding frame 11 and is further supported by an arcuate tube at a rear edge of the enclosure. The closed end 5 is supported by connection to the junction 24 of the support struts 9 and 10. The closed end 5 is created by circumferentially binding the enclosure 3 adjacent the closed end 5. A disc or cup (not shown) of plastics material is secured at the closed end to prevent a ball from becoming jammed at the closed end 4 and also to reduce wear at that area.

A support hem 26 is provided in the enclosure 3 adjacent the upstanding frame 11. The upstanding frame 11 supports the enclosure 3 by being inserted into the support hem 26.

The enclosure 3 extends to each side 12 and 13 of the base 8 to provide lateral panels 30 and 31 to each side 12 and 13 of the base 8 rearwardly of the front member 16 of the base 8. The upper rear edge 32 of the open end 4 of the enclosure 3 is of a general arcuate configuration, extending from the rear corners 22 and 23 of the base 8 and being inclined forwardly from the ends to pass adjacent the uppermost point 33 of the upstanding frame 11. Thus, the portion of the enclosure between the open end 4 and the upstanding frame 11 provides the lateral panels 30 and 31. The upper rear edge 32 is provided with a hem (not shown) into which is inserted a resiliently flexible tube. Due to its resilience, when inserted into the arcuate hem, the tube biases the upper rear edge 32 outwardly or in a sidewards direction so that the lateral panels 30 and 31 do not interfere with the golfer's swing. The tube accommodates a filament which extends through the elongate member and which is fixed at either end to the base 8.

Figure 7:
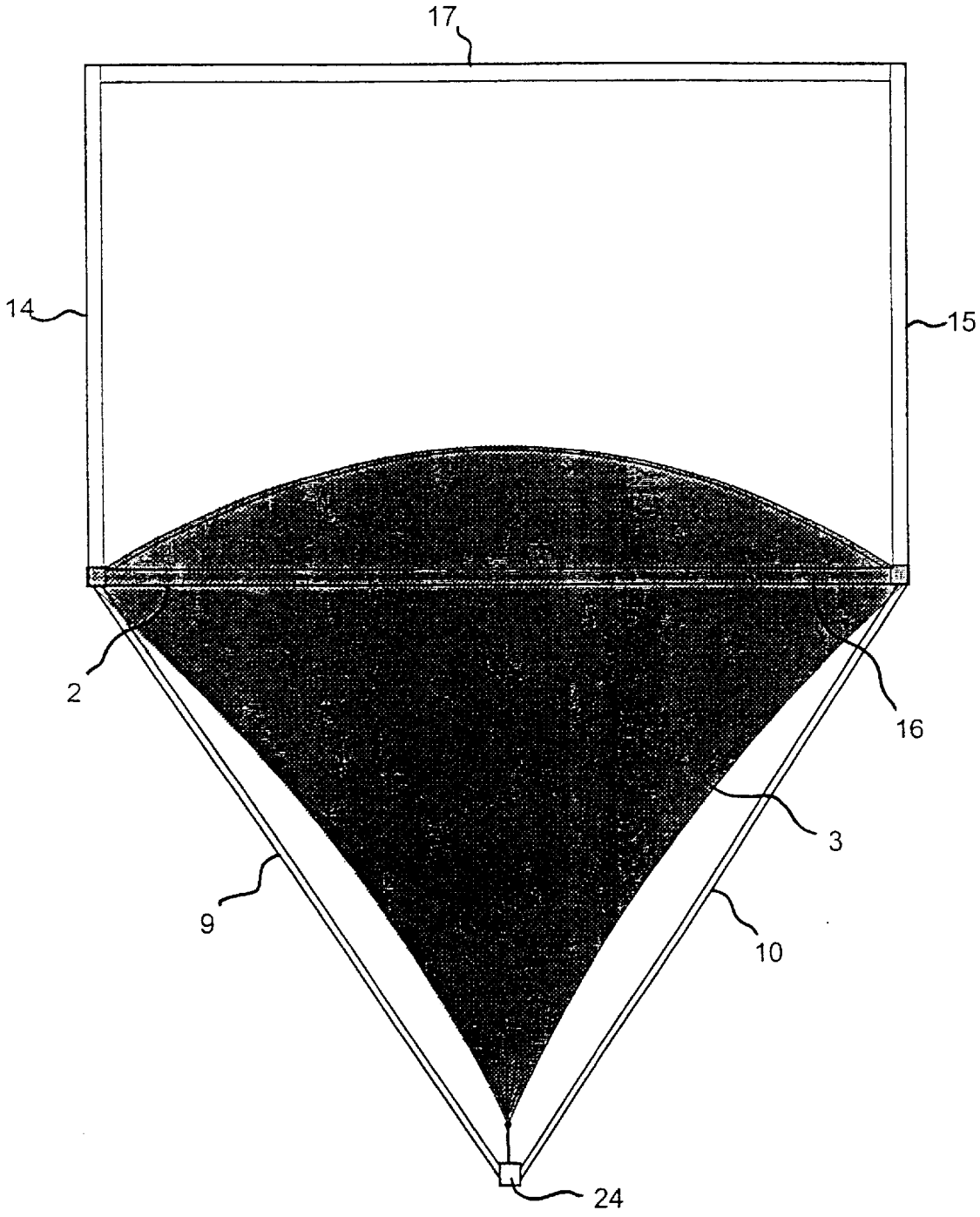
FIG. 7 is a plan view of the base of a device for practising golf as shown in FIG. 1 with the base panel removed.
Figure 8:
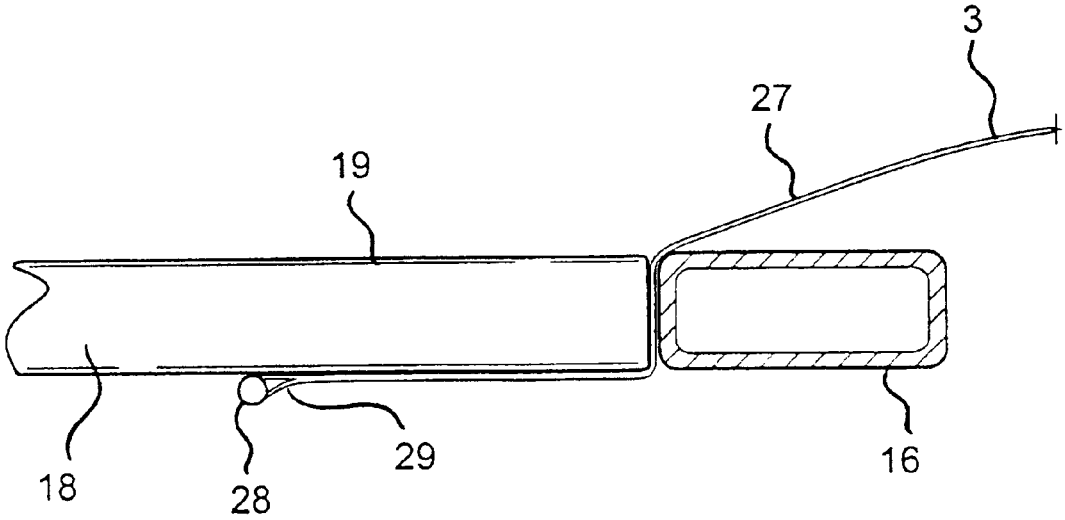
FIG. 8 is a sectional view through the front of the base of a device for practising golf as shown in FIG. 1.

As shown in FIG. 8, the open end 4 of the enclosure is also provided with a portion 27 which extends over the base frame front member 16 and underlies the base panel 18. This portion extends between the sides 12 and 13 of the base and is supported by a flexible resilient rod 28 received in a hem 29 at the edge of the enclosure portion 27. As shown in FIG. 7, the rod 28 is bent into an arc extending rearwardly away from the front member 16 and is fixed at each end to the side members 14 and 15 of the base 8 at the front corner elements 20 and 21. This novel restraining method mechanism displays two advantages. As shown in FIG. 8, by passing the enclosure portion above the front member of the base frame, the presence of a lip of bump in the path of a ball returning to the playing surface 19 is avoided. Further, by bending the rod 28 into an arc, the enclosure 3 is better able to adopt its natural shape about the rod 28 when it is tensioned.

Figure 9:
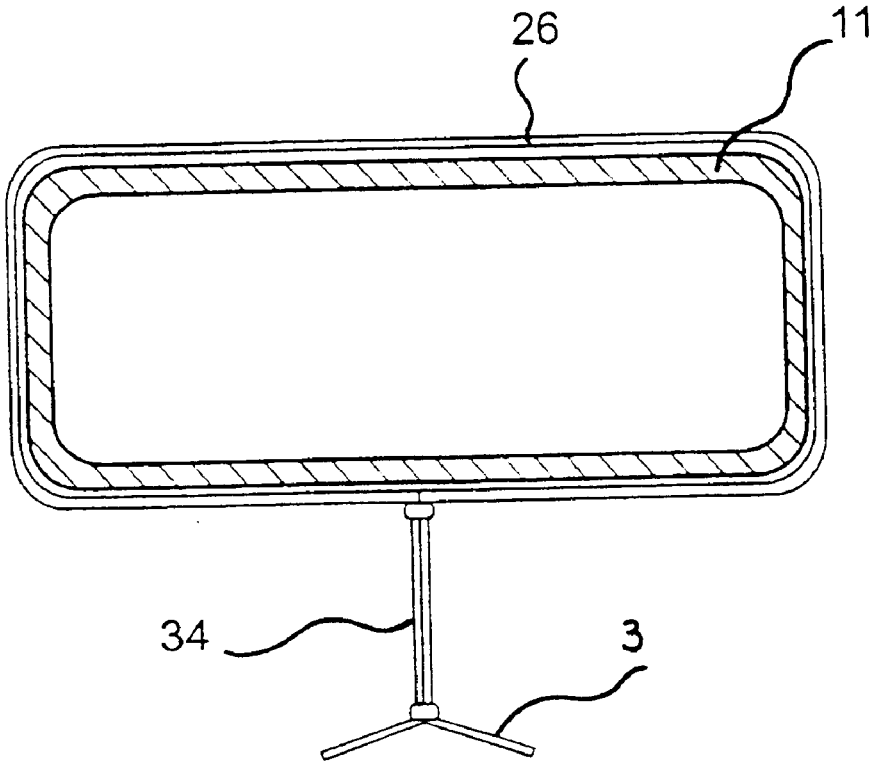
FIG. 9 is a sectional view through an upstanding frame member of a device for practising golf as shown in FIG. 1

A further feature of the invention resides in the way in which the enclosure 3 is extended rearwardly of the upstanding frame. As shown in FIG. 9, the enclosure membrane 2 is supported by the support hem 26 via a support webbing 34 to hold the enclosure membrane clear of the upstanding frame member 11. As a result, the upstanding frame member 11 cannot be directly struck by a mis-hit ball, thus avoiding or at least reducing the risk of such a ball rebounding adversely towards the user.

As a result of this novel manner of providing the lateral panels 30 and 31, the height of the upstanding frame above the support surface on which the device is located can be restricted to less than the height of an average player while the lateral panels 30 and 31 provide a semi-canopy over the base area which will capture almost any possible mis-hit ball and yet which does not interfere with the club of the golfer during the golf swing. This enables the device to be sufficiently small to be used in normal domestic rooms, while providing the safety necessary for such use.

Figure 5:
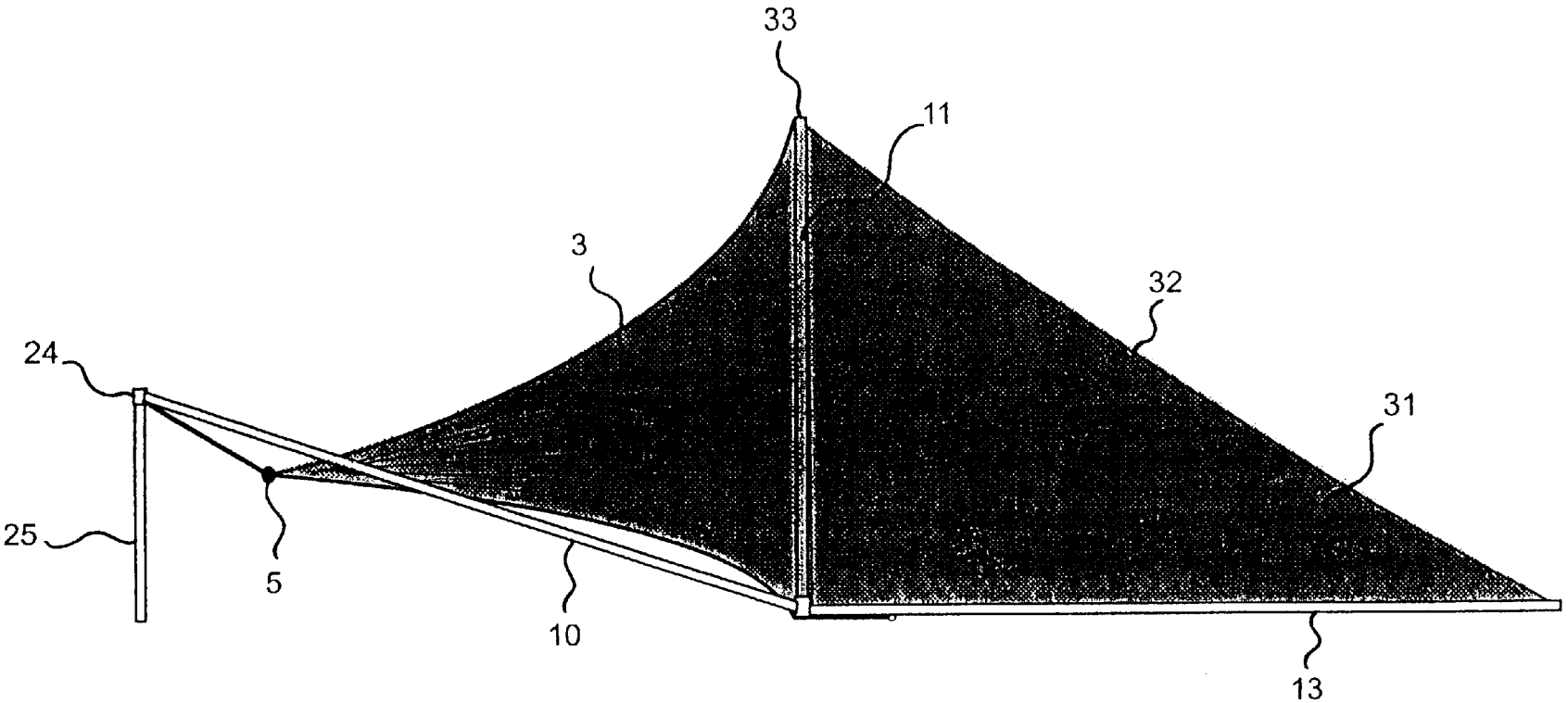
FIG. 5 is a side view of the device for practising golf as shown in FIG. 1.

The closed end of the enclosure 3 is secured to the junction of the support struts under tension to give it its shape and create the space into which the ball is struck. While certain prior art devices have disclosed an enclosure having a frusto-conical shape obtained by stretching the net under considerable tension, it has been found advantageous to erect the enclosure 3 under reduced tension so that it adopts a form akin to that of a trumpet horn, as shown in FIG. 5. In that shape, the enclosure 3 is not unduly taut so that, on impact of the ball upon the enclosure membrane, the adjacent area of membrane can be displaced substantially transversely to the surface of the enclosure. This displacement allows the enclosure to absorb the kinetic energy of the ball without imparting substantial rebound velocity or causing damage to the material, as can be the case if the material is held very taut.

In use, a user who wishes to practice their golf shots places a ball on the playing surface on the base 8. The user then aims the ball towards the open end 4 of the enclosure 2. The ball once struck will move towards the closed end 5 either directly or indirectly by deflecting from the enclosure towards the closed end 5. The ball loses it energy due to the impact with the surrounding wall and will return to the feet of the user since the substantially trumpet shape biases the slope such that the ball will return to substantially the same position on the playing surface 19 as the ball was initially struck.

According to another embodiment, the upstanding frame is formed from a resilient rod which can be bent such that the ends are located in the front corner elements.

Those skilled in the art will appreciate that the invention described herein is susceptible to variations and modifications other than those specifically described. It is to be understood that the invention includes all such variations and modifications which fall within its spirit and scope and that the invention should not be limited to the particular embodiment(s) described above.

The claims defining the invention are as follows:

1. A device for practicing ball sports comprising an enclosure defined by a membrane supported from a self-supporting structure, said structure comprising a base having a playing surface and having a forward edge and a support means spaced forwardly and upwardly of the base and supported at least in part from the base, said structure further comprising an upstanding frame supported from sides of the base and extending over the base and having an uppermost point, said enclosure being supported from said structure to define a space having an open end and a closed end, said space being of a general conical configuration, said open end being supported from the base to maintain said open end in an open condition adjacent the forward edge and the closed end being supported from the support means in spaced relation to the open end, wherein a lower portion of the enclosure is inclined downwardly from the closed end to the base to enable a ball thereon to return to the playing surface and wherein the enclosure extends to each side of the base to provide lateral panels to each side of the base rearwardly of the forward edge of the base, the open end having an upper rear edge extending from adjacent the rear of the base and being inclined forwardly from adjacent the rear of the base to pass adjacent the uppermost point of the upstanding frame, and wherein the membrane is formed of netting in cylindrical form.

2. A device for practicing ball sports according to claim 1 wherein the playing surface provides a support surface from which a ball can be struck into the space through the open end.

3. A device for practicing ball sports according to claim 1 wherein the open end of the enclosure is of a general arcuate configuration having ends located at each side of the base rearwardly of the forward edge, said open end being inclined forwardly from the ends wherein the portion of the enclosure between the open end and the upstanding fame provides the lateral panels.

4. A device for practicing ball sports according to claim 1 wherein the open end is defined by a first resiliently flexible elongate member received in an edge of the membrane and resiliently deformed to define the open end, the first resiliently flexible elongate member being adapted to bow said lateral panels outwardly so that in use said lateral panels are maintained in an arch such that they do not interfere with the swing of the user.

5. A device for practicing ball sports according to claim 4 wherein the first elongate member is hollow and accommodates a filament which extends through the elongate member and which is adapted to be fixed at either end to the base.

6. A device for practicing ball sports according to claim 1 wherein the tension of the membrane defining the enclosure between the upstanding frame and the closed end is such as to allow for movement of the membrane transverse to the surface of the space to enable the membrane to absorb the impact forces of any ball impacting on the membrane.

7. A device for practicing ball sports according to claim 1 wherein the space between the upstanding frame and the closed end is trumpet shaped.

8. A device for practicing ball sports according to claim 1 wherein the base comprises a substantially rectangular or square frame which defines the forward edge and sides of the base and which provides a playing surface which comprises a panel received by the rectangular or square frame.

9. A device for practicing ball sports according to claim 1 wherein the base comprises a substantially rectangular or square base frame defined by a plurality of elongate elements fixed at their ends by corner elements and said support means comprises a strut member mounted to each side of the base frame adjacent to the forward edge and extending forwardly from the forward edge, said strut members converging to be supported by a junction element, said junction element being supported by an upstanding frame element depending downwardly therefrom, said junction element providing support for the closed end.

10. A device for practicing ball sports according to claim 9 wherein the corner elements of the base located at each end of the forward edge receive and support said strut members.

11. A device for practicing ball sports according to claim 9 wherein the corner elements of the base located at each end of the forward edge receive and support the ends of the upstanding frame.

12. A device for practicing ball sports according to claim 1 wherein the lateral panels are integral with the membrane.

13. A device for practicing ball sports according to claim 1 wherein the enclosure is supported from the upstanding frame by a support hem to hold the enclosure clear of the upstanding frame.

14. A device for practicing ball sports comprising an enclosure defined by a membrane supported from a self-supporting structure, said structure comprising a base having a playing surface and having a forward edge and a support means spaced forwardly and upwardly of the base and supported at least in part from the base, said structure further comprising an upstanding fame supported from sides of the base and extending over the base and having an uppermost point, said enclosure being supported from said structure to define a space having an open end and a closed end, said space being of a general conical configuration, said open end being supported from the base to maintain said open end in an open condition adjacent the forward edge and the closed end being supported from the support means in spaced relation to the open end, wherein a lower portion of the enclosure is inclined downwardly from the closed end to the base to enable a ball thereon to return to the playing surface and wherein the enclosure extends to each side of the base to provide lateral panels to each side of the base rearwardly of the forward edge of the base, the open end having an upper rear edge extending from the rear of the base and being inclined forwardly from the rear of the base to pass adjacent the uppermost point of the upstanding frame, wherein the open end is defined by a first resiliently flexible elongate member received in the upper rear edge of the membrane and resiliently deformed to define the open end, and wherein the open end of the enclosure is further defined by a portion which underlies the base and which extends between the sides thereof, and wherein the membrane is formed of netting in cylindrical form.

15. A device for practicing ball sports according to claim 14 wherein the enclosure has the general shape of a cylinder wherein one end of the cylinder accommodates the first elongate element and the other end is gathered to provide the closed end.

16. A device for practicing ball sports according to claim 14 wherein said portion of the open end underlying the base comprises a flexible resilient second elongate member received in an edge of the membrane and fixed at its ends to the sides of the base and said second elongate member being resiliently bent to an arcuate configuration extending rearwardly away from the forward edge.

17. A device for practicing ball sports, comprising:

a base having a front, a&ea, and a pair of sides;

a playing surface upon which a person using the device is intended to stand during use, the playing surface being defined between the front, rear and sides of the base;

an upstanding frame extending upwardly from the sides of the base adjacent the front, said frame having an uppermost point;

support means connected to the base adjacent the front thereof and extending forwardly of the front; and an enclosure having an open end and a closed end, the closed end being supported by the support means forwardly of the front of the base, and the open end being supported by the upstanding frame, the enclosure having a lower portion between the closed end and the front of the base that is inclined downwardly from the closed end to the front of the base to enable a ball to return to the playing surface, and the enclosure further includes lateral panels extending rearwardly from the upstanding frame along each side of the base to adjacent the rear of the base, each lateral panel decreasing in height from adjacent the uppermost point to adjacent the rear of the base, and wherein the enclosure is formed of netting in cylindrical form.

18. A device for practicing ball sports according to claim 17 wherein the lateral panels are integral with enclosure.

19. A device for practicing ball sports according to claim 17 wherein the open end of the enclosure is further defined by a portion which underlies the base and which extends between the sides thereof.

* * * * *

UNITED STATES PATENT AND TRADEMARK OFFICE

CERTIFICATE OF CORRECTION

PATENT NO. : 6,749,520 B1
DATED : June 15, 2004
INVENTOR(S) : Neskudla et al.

It is certified that error appears in the above-identified patent and that said Letters Patent is hereby corrected as shown below:

Column 8,
Line 50, “a front, a&ea, and” should read -- a front, a rear, and --

Column 10,
Line 2, “with enclosure” should read -- with the enclosure --

Signed and Sealed this

Ninth Day of November, 2004

JON W. DUDAS
*Director of the United States Patent and Trademark Office*